US010935356B1

(12) United States Patent
Steven

(10) Patent No.: US 10,935,356 B1
(45) Date of Patent: Mar. 2, 2021

(54) EMPTY CASING FEED FOR A RELOADER

(71) Applicant: Daniel Steven, Troy, IL (US)

(72) Inventor: Daniel Steven, Troy, IL (US)

( * ) Notice: Subject to any disclaimer, the term of this patent is extended or adjusted under 35 U.S.C. 154(b) by 0 days.

(21) Appl. No.: 16/851,640

(22) Filed: Apr. 17, 2020

(51) Int. Cl.
*F42B 33/10* (2006.01)
*F42B 33/00* (2006.01)
*F42B 33/02* (2006.01)

(52) U.S. Cl.
CPC ..... *F42B 33/004* (2013.01); *F42B 33/002* (2013.01); *F42B 33/0207* (2013.01)

(58) Field of Classification Search
CPC ..... F42B 33/004; F42B 33/002
USPC ..... 86/27, 23, 45, 46
See application file for complete search history.

(56) References Cited

U.S. PATENT DOCUMENTS 3,610,090 A * 10/1971 Corcoran ..... F42B 33/10 86/45
4,455,915 A * 6/1984 Ransom ..... F42B 33/002 86/26
5,763,810 A * 6/1998 Lee ..... F42B 33/002 86/23
6,772,668 B2 * 8/2004 Shields ..... F42B 33/0207 86/31
9,267,775 B1 * 2/2016 Kleinschmit ..... F42B 33/001

* cited by examiner

*Primary Examiner* — Reginald S Tillman, Jr.
(74) *Attorney, Agent, or Firm* — Don W. Weber

(57) ABSTRACT

A discrete empty casing feeder for a cartridge reloader is controlled electronically by a control module. Empty casings are loaded on top of each other in a conventional feeder tube and are gravity fed through the feeder tube onto an upper rotating carousel. The discrete empty casing drops into a cylinder in the upper carousel and the carousel and casing rotate until the casing reaches a hole in the floor under the upper carousel. The discrete empty casing drops onto a solenoid lever in a tube. When the typical lower turret is raised mechanically, a sensor detects that the lower turret and push ram are in the correct position. The trap lever opens and drops the empty shell casing into a slot in the front of the push ram. The push ram then pushes the correctly oriented discrete casing onto the conventional turret. As the shell casings go through a normal reloading cycle, a fully loaded cartridge is ejected from the lower turret and the entire process begins again.

6 Claims, 8 Drawing Sheets

EMPTY CASING FEED FOR A RELOADER

BACKGROUND OF THE INVENTION

This invention relates to the field of a bullet reloading mechanism for cartridge reloading. More particularly a mechanism is disclosed that automatically feeds a discrete spent shell casing onto a turret plate to enable the automatic reloading of an empty shell case to produce a fully loaded and operational cartridge for a rifle or pistol.

Cartridge reloaders are well known throughout the art and have a generally used and acceptable configuration. Automatic reloading of a spent shell casing is accomplished by placing the empty shell casing onto a rotating turret. The turret optimally has a plurality of sequential stations, usually five, used to reload the empty shell casing. Typically, these stations sequentially resize the empty casing, remove an old primer and insert a new primer, load powder, seat a bullet and crimp the casing to produce a fully reloaded cartridge.

Good examples of this process and a general description of the reloading mechanism can be found in the 2004 US patent issued to Shields, U.S. Pat. No. 6,722,668 B2, the 2016 patent issued to Kleinschmit, U.S. Pat. No. 9,267,775 B1, and the 1998 US patent issued to Lee, U.S. Pat. No. 5,763,810. All three of these patents describe the reloading process and disclose the method and mechanism used once the empty shell casing 20 of Lee is inserted onto the rotating turret, 19 of Lee, for example.

One of the problems encountered in the automated reloading of empty shell casings is that shell casings will jam when conventional methods and mechanisms of feeding the empty shell casings is used. Shell casings stacked on top of each other in a feeder tube type feeder tend to jam at the bottom as the push ram pushes one casing toward the turret. This jamming could be eliminated if a discrete casing is fed onto the push ram. It is an important aspect of this invention to provide a mechanism whereby a single discrete empty casing is inserted into the push ram slot.

A large problem in the reloading art is tipping of casings caused by the stacking nature of a gravity feed system. Many times, empty casings will fall over or down and off the reloading mechanism. The sheer weight of the stack of casings can cause the casing to fly out or even off the reloading press. These occurrences can cause a disruption to the progressive process of reloading and is frequently a cause of a reloading assembly line break down. It is another object of this invention to capture a discrete casing from the standard feeder tube in an upright and correct orientation and to keep the casing in such correct orientation by capturing the shell casing in the upper carousel.

One method and mechanism to improve the feeding process is shown and described by Ransom, 1984 U.S. Pat. No. 4,455,915. Ransom discloses a semi-circular feeder reservoir 60 with a horizontal bar 74 and a drop tube 72. The drop tube uses gravity flow to sequentially drop an empty shell casing into place. One purpose of the Ransom mechanism is to feed shell casings from the upper reservoir with the rim portion of the casing down in the feeder tube. However, the gravity feed of Ransom has the drawback that different sized shell casings will jam at the lower end of the feeder tube. It is another object of this invention to provide a mechanism to prevent empty shell casings from jamming once they are released from an upper feeder tube.

Any mechanism that provides for correct geometric feeding of an empty shell casing onto the turret must necessarily deal with simultaneous problems of correct geometric orientation of the empty casing and pushing the empty casing onto the turret, or lower platform. Since many reloading devices use a manual lever to operate the system, and an upper hopper and tube to gravity feed the empty shell casings at the start of the operation, it would be beneficial to provide a mechanism that uses these elements in conjunction with other structure to correctly orient and load the empty casing onto the turret. It is still another object of this invention to provide a mechanism that can be readily attached to existing reloaders but that provides unique structure to orient a discrete empty shell casing correctly and to feed the empty shell casing onto the turret.

Other and further objects of this invention can be discovered by reading the below described Description.

BRIEF DESCRIPTION OF THE INVENTION

An automatic feeder mechanism is controlled electronically by a control module, sensors and motors. A discrete empty shell casing is fed by gravity onto an upper rotating carousel. A discrete empty casing drops onto the carousel top and cylinder and is captured by the carousel. The casing then drops into a lower tube as the carousel rotates. The upper carousel then stops. The empty casing rests on a pivoting solenoid trap lever in the tube. The tube may be clear to accommodate a photo light beam. The casing sensor detects when the empty shell casing is in the tube resting on the trap lever. When the lower turret platform and ram are in position, a lower platform sensor sends a signal to the control module. The a is usual in the reloading art. Further manual operation of the lever arm rotates the turret platform about its central axis and the shell casings are sequentially loaded at the typically five stations as described in the literature.

Once the normal cycle of reloading is complete, a fully reloaded cartridge is ejected from the entire apparatus and the reloading cycle starts over again. The control module also starts a new cycle when the fully loaded cartridge is ejected and the manual arm is lowered. The control module sends a signal to the motor that drives the upper carousel, the upper carousel rotates, a new discrete empty shell is fed into the upper carousel cylinder and the cycle begins again.

DETAILED DESCRIPTION OF THE INVENTION

This invention is designed to properly load a discrete bullet casing in a vertical position onto a standard lower turret as is commonly used in the reloading art. The lower turret rotates through stations to reload the casing as is common in the art. Operation of the lower turret and reloader is well described in United States Patents issued to Lee, U.S. Pat. No. 5,763,810 and to Shields U.S. Pat. No. 6,772,668. Specifically, FIG. 1 of Lee shows his lower turret plate (Lee, 19) which is raised by a lever (Lee, 13) to raise an empty shell casing (Lee, 20) into the dies. The turret plate of Lee rotates through stages, usually five to reload the empty casing. (Lee, Column 1, lines 23-35.)

Figure 4:
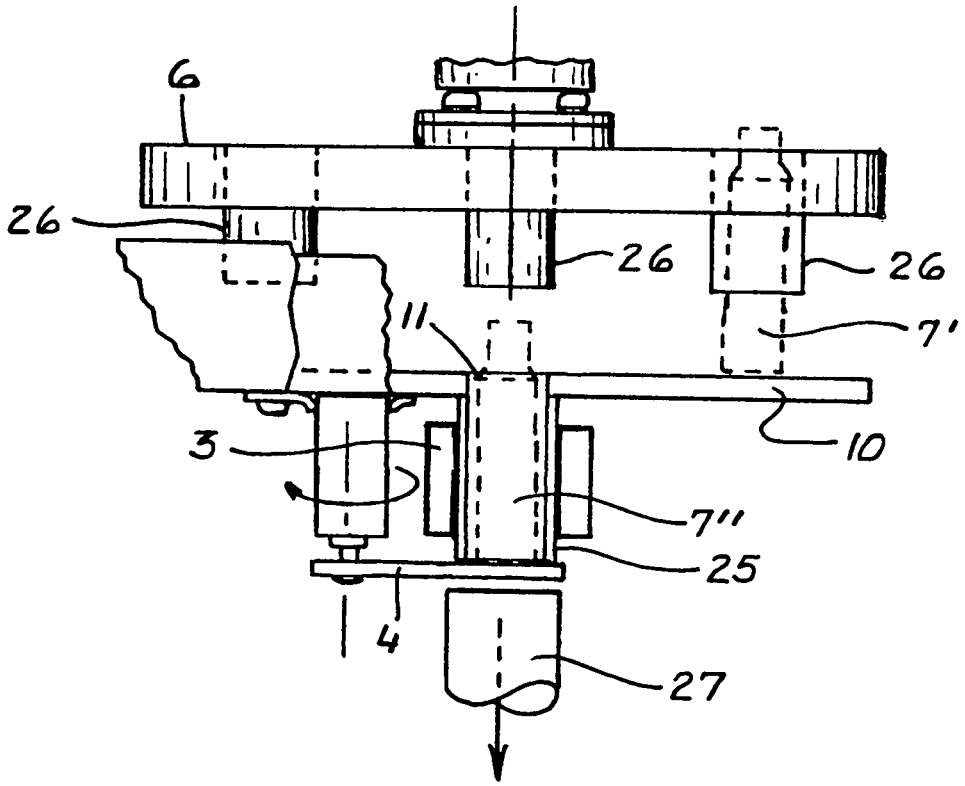
FIG. 4 is a detailed side view of the upper carousel and trap lever mechanism of the device.

FIG. 4 of Lee shows how his feeder tube 47 feeds empty shell casings into a pusher mechanism 37 and onto the rotating turret 19. Although Lee uses grippers to hold the empty casing once the empty casing is positioned onto the turret (or in the instant invention, lower turret platform 13) the action of the reloading device is the same. The action of the rotating turret, once the empty shell casing is positioned and inside the reloading dies, is well known in the art and is described in the Lee patent and the Shields patent in detail. This invention relates to the upper part of a reloader and is a mechanism for positioning a discrete empty casing onto the lower turret.

Figure 1:
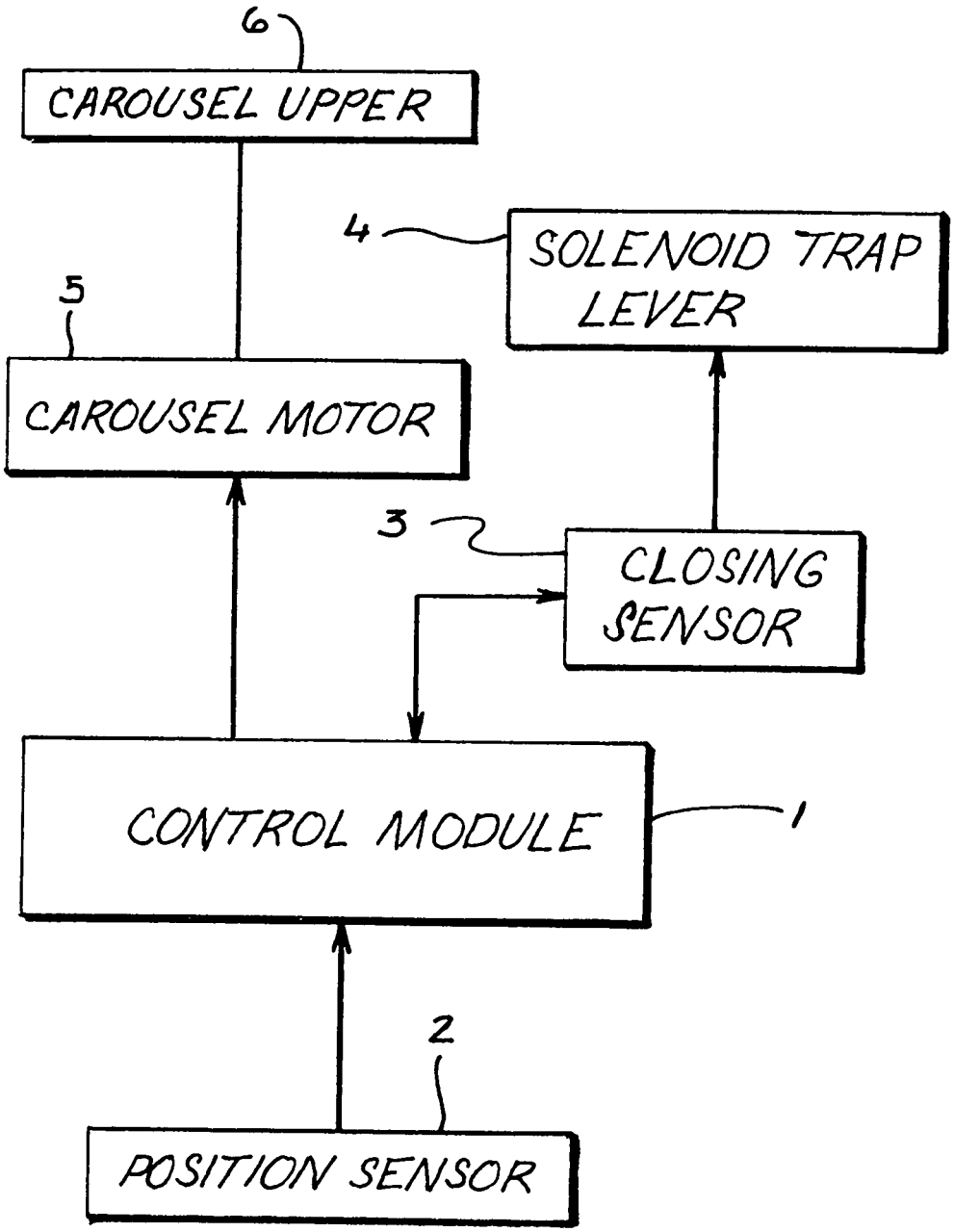
FIG. 1 is a schematic of the electronic functions of the device.

As shown schematically in FIG. 1, this empty shell casing placement mechanism is controlled automatically by a control module 1. Control module 1 is electronically connected to lower turret platform position sensor 2, empty casing closing trap sensor 3 and solenoid trap lever 4, and upper carousel motor 5 and upper carousel 6.

Figure 2:
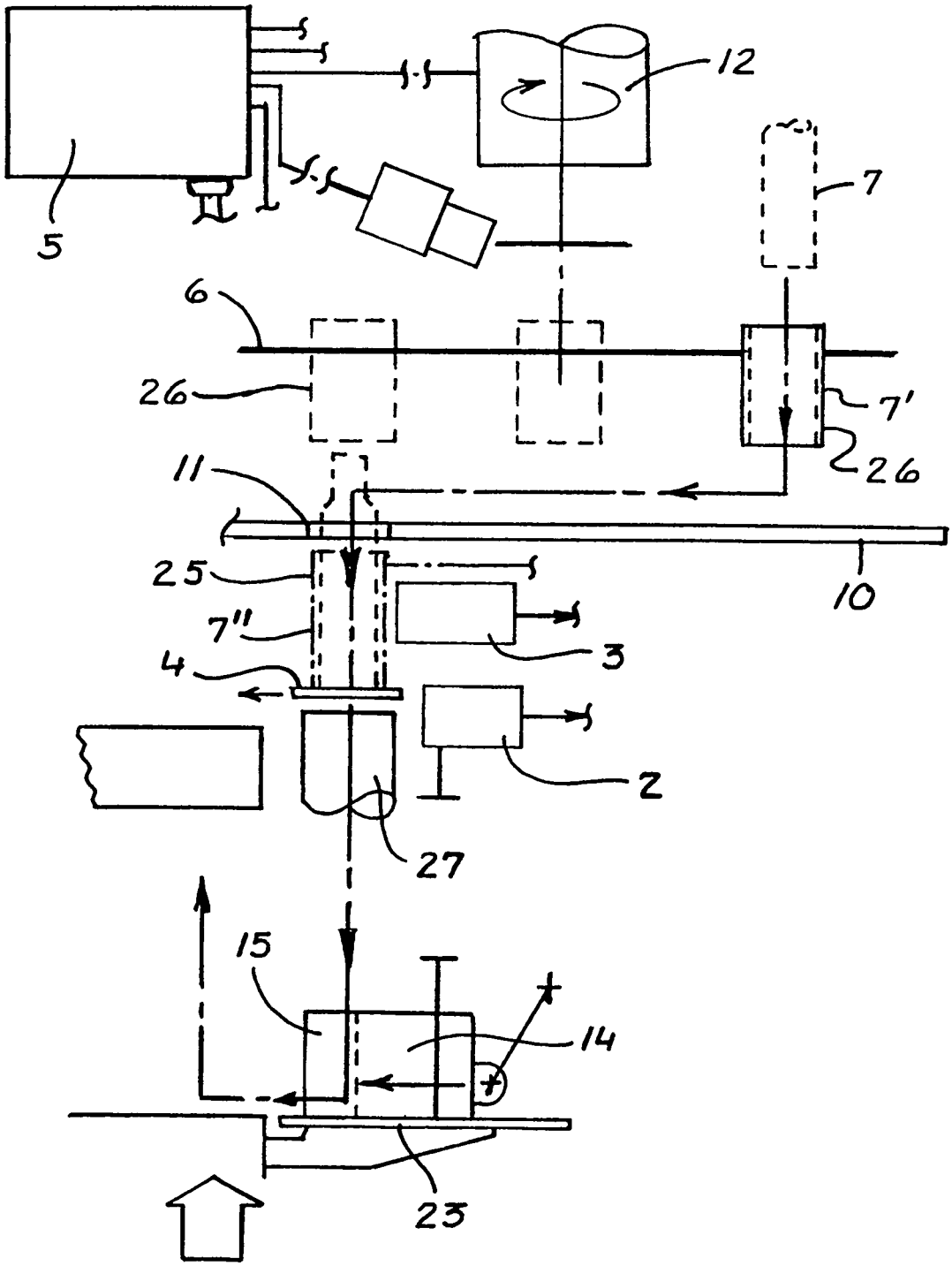
FIG. 2 is a side cutaway view of the upper carousel and trap lever portion of the device.

Upper carousel 6 rotates in a clockwise fashion by carousel gear 12 until a discrete empty shell casing 7 drops from a standard feeder tube 8 onto the upper carousel 6 into a cylinder 26. As shown in FIG. 2, discrete empty casings 7 in the feeder tube drop into the carousel cylinders 26. A discrete casing 7', in the cylinder, with further rotation of the upper carousel, drops into a solenoid tube 25 and rests on solenoid lever 4. Empty casing sensor 3 detects the presence of an empty shell casing 7" and sends a signal to the control module that an empty shell casing is inside the solenoid tube 25. Solenoid lever 4 is actuated by solenoid 4'.

The lower platform is raised by the manual lever arm. When control module 1 receives an electronic signal that the lower platform 13, ram 14 and turret floor 24 is near the die platform 22 (upper position), and that an empty casing is correctly positioned on top of solenoid trap lever 4 in solenoid tube 25, the control module activates the trap lever solenoid 4' so that the trap lever 4 is withdrawn from the bottom of empty shell casing 7" allowing empty shell casing 7" to fall though solenoid tube 25 into lower ram tube 27 and into the slot 15 of horizontal ram 14.

The reloader is then operated manually to reload the shells at the five reloading stations described in the literature and prior patents. This new improvement is designed to provide structure to place one discrete empty casing onto ram slot 15, rather than the simple feeder tube drop method previously disclosed in the literature.

Figure 3:
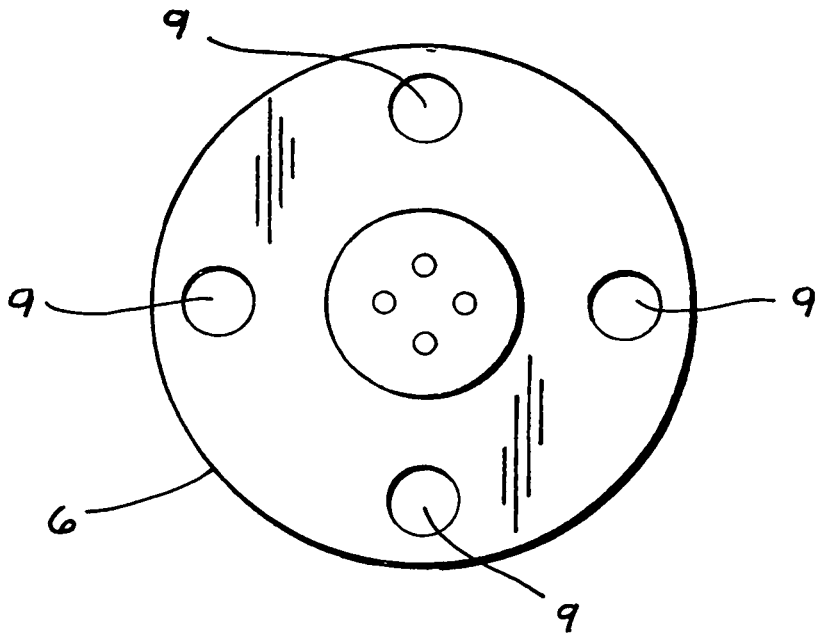
FIG. 3 is a top view of the upper carousel.
Figure 5:
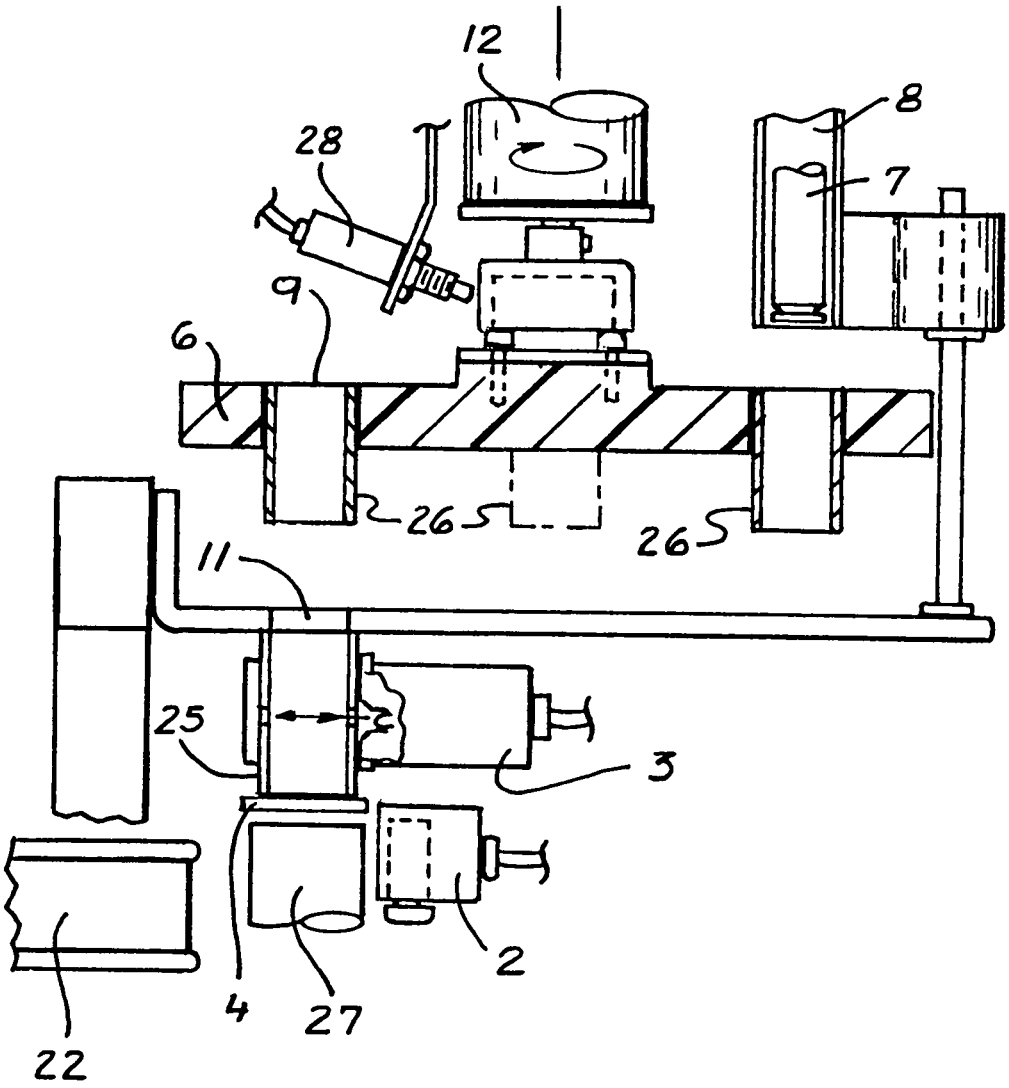
FIG. 5 is a detailed side view of the upper carousel and trap lever portion of the device also showing the feeder tube and lower turret and ram platform.

Turning now to FIGS. 2, 3 and 5 the elements of the upper carousel are shown. An empty shell casing 7 (shown in dotted lines on FIG. 2) is fed from an upper reservoir through a feeder tube 8 (FIG. 5) onto the top of upper carousel 6. (The reservoir of empty shell casings and the feeder tube are described in the patent issued to Ransom, U.S. Pat. No. 4,455,915.) The upper carousel has a plurality of empty casing receiving top apertures 9 typically four. The empty shell casing apertures 9 are best shown in FIG. 3.

The empty casing 7 falls by gravity feed into one of the holes 9 and carousel cylinders 26 as the upper carousel rotates in a clockwise direction. Each top aperture 9 is continuous with a respective carousel cylinder 26. The central axis of apertures 9 align with the central axis of carousel cylinders 26.

Figure 7:
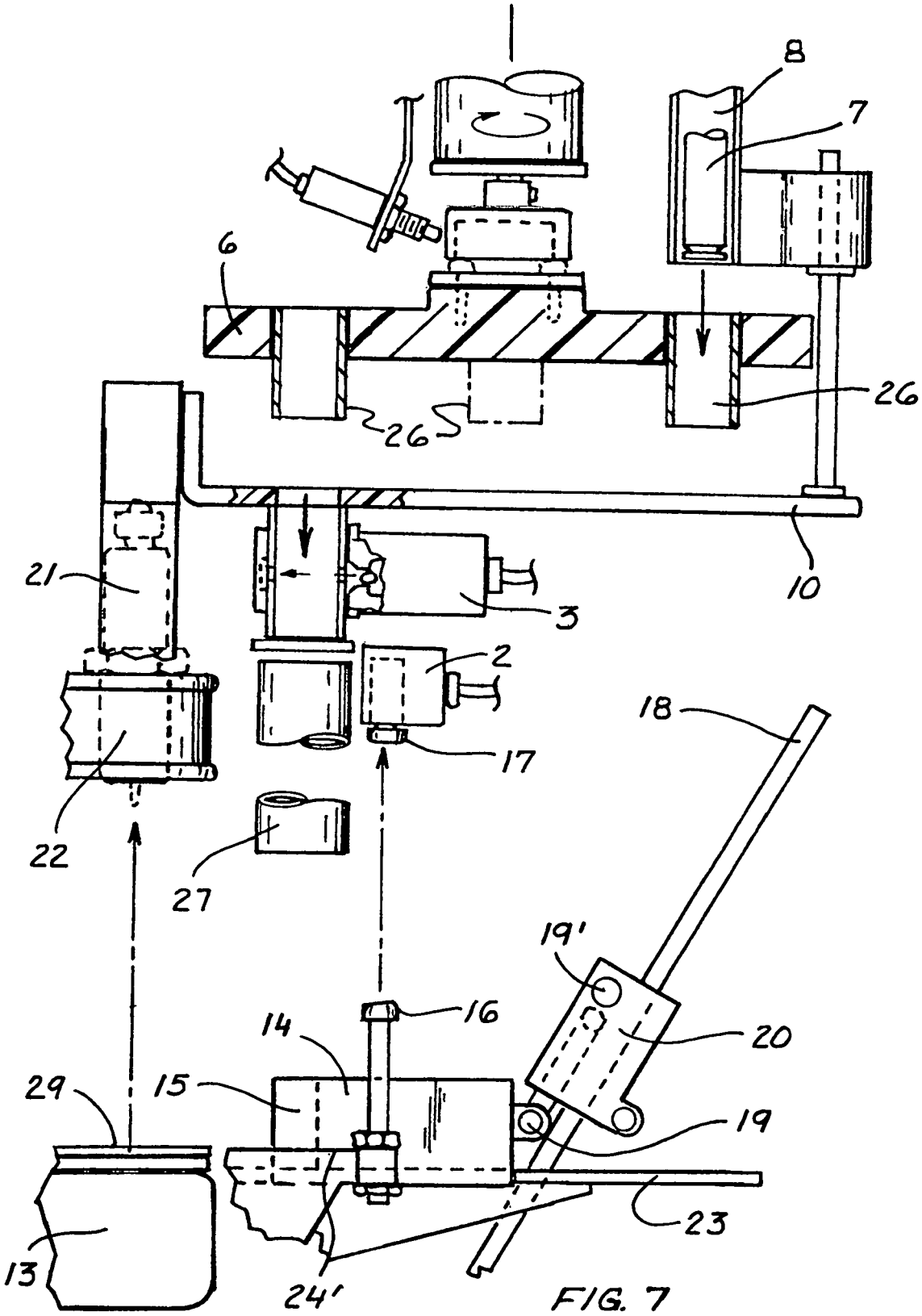
FIG. 7 is a detailed side view of the instant improvement device showing the entire casing feeding structure, the ram and the lower platform.
Figure 8:
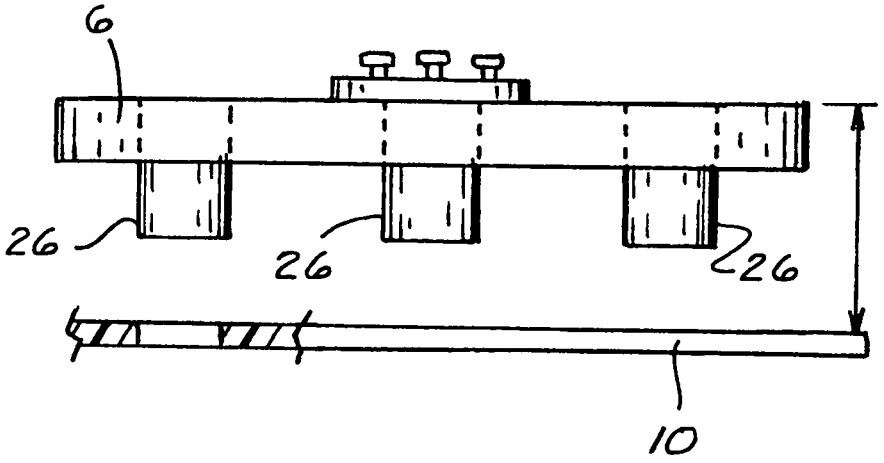
FIG. 8 is a side view of the upper carousel used for longer shell casings.
Figure 9:
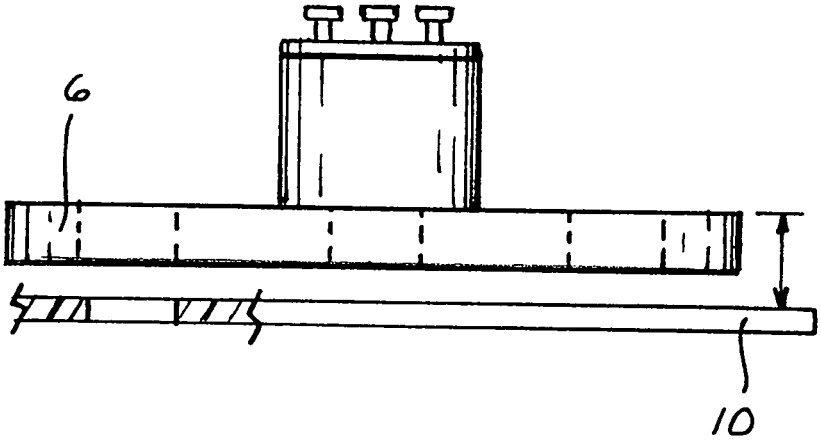
FIG. 9 is a side view of the upper carousel used for shorter casings.

Top apertures 9 are continuous with upper carousel cylinders 26. Both the empty casing receiving apertures 9 and upper carousel cylinders 26 have the same central axis as shown in FIGS. 7, 8 and 9. An empty casing 7 drops into one of the holes 9 and upper carousel cylinder 26 as the carousel 6 rotates.

Figure 6:
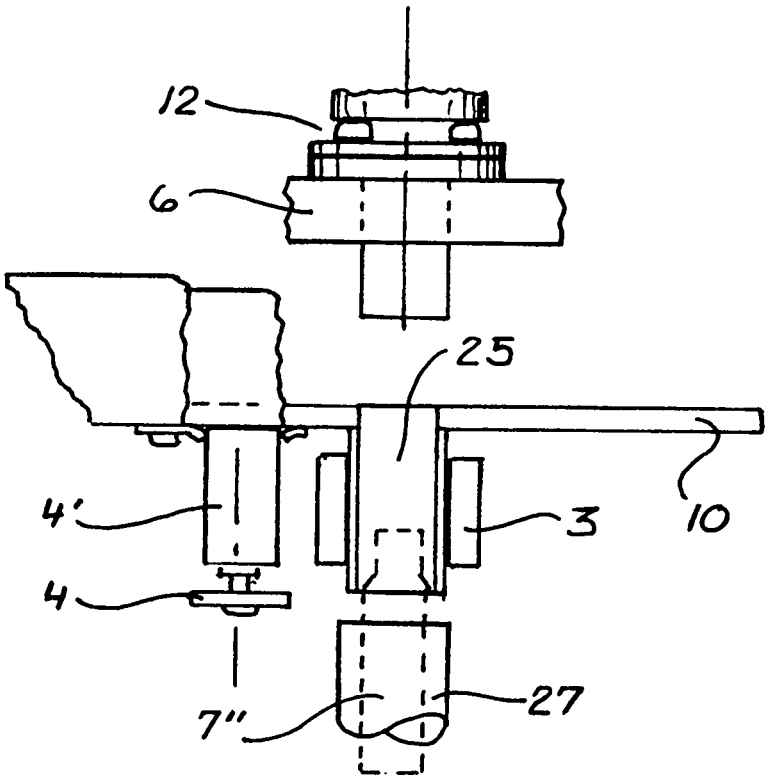
FIG. 6 is a detailed partial side view of the device shown with the trap lever open and the casing partially in the solenoid tube and partially in the lower ram tube.

The bottom of the empty casing 7' is stopped by the carousel floor 10 of the upper carousel as the upper carousel rotates. As best shown in FIG. 4, casing 7' slides along the floor 10 until it reaches the upper carousel floor aperture 11. The carousel floor 10 has only one aperture, 11. Empty casings, typically four, slide on the floor 10 until one empty casing 7' aligns with the floor aperture 11. The empty casing 7' then falls through aperture 11 into solenoid tube 25, which may be clear to accommodate the closing sensor 3 as best shown in FIG. 6. The descent of empty shell casing 7" is stopped when the bottom of casing 7" contacts and sits on a pivotable solenoid trap lever 4.

The empty shell casing is now positioned in solenoid tube 25, with the bottom of the empty casing 7" resting on the solenoid lever 4. The tube 25 may be clear to accommodate a photo sensor light beam or it may simply be a tube with a hole drilled into it for the photo light beam pathway so that it can be used as a sensor. An empty shell casing light sensor 3 senses that the empty shell casing 7" is correctly positioned in solenoid tube 25 and on the top of the solenoid lever 4 and sends a signal to control module 1. The control module then stops the rotation of the upper carousel until the empty casing 7" is dropped onto the push ram platform.

Once an empty shell casing 7" is positioned in the solenoid tube 25, the operation of the manual lever arm raises the lower platform as is generally well known in the art. This operation is best shown in FIG. 7.

Turning to FIG. 7, a lower turret platform 13 is typically circular and is continuous with the push ram 14. The lower turret platform 13 has the same vertical axis as the typically circular die platform 22. The die platform 22 contains a plurality of dies 21, typically five, used typically and sequentially, as is well known in the art, for removing the primer, adding powder, placing the bullet and seating and crimping the bullet. (See, for example, Lee, Column 1, lines 29-37.) The die platform 22 is stationary and does not rotate.

The lower platform 13 is continuous with a push ram 14. The top 24 of the lower platform 13 and the top 24' of the push ram floor are horizontally level as shown at the lower left part of FIG. 7.

Push ram 14 has a front push ram casing receiving slot 15 at the front of the push ram. This slot is semi-circular and is adapted to receive an empty shell casing 7" from lower ram tube 27. The push ram is pivotally attached to a push ram movement mechanism 20 at pivot points 19 and 19' and slides along the push ram slide 23. The movement mechanism 20 travels along push ram rod 18. The movement of the lower turret platform and push ram by the manual lever are well known in the art and do not function differently from reloaders previously used and described in the literature.

Attached to the lower platform 13 is a lower platform position bolt 16. The position sensor 2 has a position sensor proximity point 17 attached near the solenoid trap lever 4 at a position sensor proximity point as shown. Position sensor 17 may be an induction type sensor. When the lower platform position bolt 16 is in proximity to the position sensor proximity point 17, the position sensor 2 sends a signal to the control module 1. The control module 1 then opens the solenoid lever 4 and the empty shell casing 7" drops into the ram tube 27 and onto the horizontal floor 24' at push ram casing receiver slot 15. Solenoid lever 4 typically stays open for about one-half a second when it operates to release the empty shell casing. The lower platform continues its upward motion until the empty shell casing (now one of five shell casings being staged in the typical reloading operation) begins its rotation into the reloader mechanism.

The push ram moves horizontally forward from right to left in FIG. 7 and pushes the empty shell casing 7" into an empty position on the lower turret 13. The die platform 22 also has a vacant casing position because the lower turret 13 has rotated one sequential position and has ejected a fully loaded cartridge as is well known in the art. The manual arm, known in the art, operates to withdraw and then sequentially index the lower turret. As the manual arm is mechanically operated, the lower platform 13 and push ram 15 are raised simultaneously. The push ram 14 and the lower platform 13 are continuous as shown in the drawing figures, especially FIG. 7.

The lower platform and ram are next withdrawn from the die platform 22, after the casings have indexed, as is well known in the art and lowered to its ready position by manually moving the mechanism arm as is well known in the art. As the manual arm raises the lower platform again, to the correctly identified and signaled position, the solenoid trap releases another empty shell casing.

Once the reloader stations all achieve their function, the lower turret rotates and a fully reloaded bullet is the ejected from the reloader, as is typical in the reloading art. A vacant position is created by the ejection of a completely reloaded shell and the above described mechanism then reinserts an empty shell casing into the empty shell casing vacant position with the push ram. The process then is repeated for successive empty shell casings.

FIGS. 8 and 9 show different configurations for the upper carousel. FIG. 8 shows the upper carousel for a longer empty shell casing, usually a rifle shell casing. FIG. 9 shows a configuration for a shorter shell casing, usually a pistol shell casing.

The upper carousel rotates at different speeds, depending on the type of empty casings being reloaded and may be monitored by RPM senor 28. However, the RPM sensor Is not essential to this invention. Generally, for shorter empty casings, like .45 caliber casings, the upper carousel rotates at about 7 RPM. For longer empty casings, like a .223 rifle casing, the upper carousel will rotate at a faster speed, typically 11 RPM. The control module has a voltage regulator that delivers a variable voltage to the upper carousel motor to determine the upper carousel's revolutions per minute.

The above described invention is disclosed in its preferred embodiment. However, the precise mechanism shown and described is meant as description only and not as a limitation. Other similar or interchangeable parts and configurations are still within the spirit and keeping of this disclosure.

The invention claimed is:

1. In a bullet reloading mechanism having a push ram with a front casing receiving slot continuous with a lower turret platform, the improvement comprising a discrete empty casing feeder mechanism comprising a control module electronically connected to an upper carousel, a solenoid trap sensor and a position sensor whereby when a discrete empty shell casing is correctly positioned above the front casing receiving slot of the push ram of a bullet reloader mechanism, the control module activates a solenoid trap lever and the empty casing drops into the front casing receiving ram slot.

2. In a bullet reloading mechanism having a push ram with a front casing receiving slot continuous with a lower platform, the improvement comprising:

(1) an upper, rotating carousel having a plurality of top holes continuous with a plurality of carousel cylinders therethrough, electrically connected to a control module;

(2) a pivotable solenoid trap lever, electrically connected to the control module and to a solenoid trap sensor;

(1) a position sensor, electrically connected to the control module and to the lower reloader platform;

whereby, a discrete empty casing is gravity fed through a feeder tube onto the upper carousel, into the upper carousel cylinders, and then gravity fed into a solenoid tube, and then released by the pivotable solenoid trap lever into the front casing receiving slot of the ram.

3. The mechanism described in claim 2, wherein the solenoid trap sensor detects the presence of an empty casing and sends a signal to the control module.

4. The mechanism described in claim 2, wherein the upper carousel has a plurality of continuous cylinders therethrough for receiving a discrete empty casing.

5. The mechanism described in claim 2, further comprising a solenoid tube wherein an empty casing rests on said trap lever until the trap lever is opened whereby an empty casing is gravity fed into said solenoid tube.

6. The mechanism described in claim 3, wherein said solenoid tube is clear.

* * * * *